US005923289A

United States Patent [19]

Buer et al.

[11] Patent Number: 5,923,289

[45] Date of Patent: Jul. 13, 1999

[54] MODULAR ARRAY AND PHASED ARRAY ANTENNA SYSTEM

[75] Inventors: Kenneth Vern Buer, Gilbert; John Wesley Locke, Tempe, both of Ariz.; R. William Kreutel, Redmond, Wash.; Paul Adrian Chiavacci, Stoneham, Mass.; Daniel Francis DiFonzo, Rockville, Md.

[73] Assignee: Motorola, Inc., Schaumburg, Ill.

[21] Appl. No.: 08/901,745

[22] Filed: Jul. 28, 1997

[51] Int. Cl.[6] ..... H01Q 3/26

[52] U.S. Cl. ..... 342/373; 342/368; 342/372

[58] Field of Search ..... 342/81, 154, 157, 342/368, 372, 373

[56] References Cited

U.S. PATENT DOCUMENTS

| | | | |
|---|---|---|---|
| 3,611,400 | 10/1971 | Nagai | 343/844 |
| 3,990,077 | 11/1976 | Beaulieu et al. | 343/854 |
| 4,500,882 | 2/1985 | Katagi et al. | 343/372 |
| 4,739,247 | 4/1988 | Cisco et al. | 323/354 |
| 5,276,452 | 1/1994 | Schuss et al. | 342/371 |
| 5,276,457 | 1/1994 | Agarwal et al. | 343/789 |
| 5,414,433 | 5/1995 | Chang | 342/375 |
| 5,446,370 | 8/1995 | Voight | 324/76.11 |
| 5,592,178 | 1/1997 | Chang et al. | 342/372 |
| 5,612,702 | 3/1997 | Kinsey | 342/427 |

*Primary Examiner*—Thomas Tarcza
*Assistant Examiner*—Dao L. Phan
*Attorney, Agent, or Firm*—Gregory J. Gorrie

[57] ABSTRACT

A modular phased array antenna for the formation of simultaneous independently steerable multiple beams, the modular phased array antenna comprising a modular array including a plurality of sub-array modules combined together in close proximity, each one of the plurality of sub-array modules including a plurality of input modules, a layer of a plurality of radiating antenna elements, a plurality of stacked beamformers arranged in series and each connected to one of the plurality of input modules and to the plurality of radiating antenna elements in beam communication.

14 Claims, 4 Drawing Sheets

MODULAR ARRAY AND PHASED ARRAY ANTENNA SYSTEM

FIELD OF THE INVENTION

This invention relates generally to the field of antennas and, more particularly, to the field of phased array antennas.

BACKGROUND OF THE INVENTION

Phased array antennas are normally composed of a number of individual radiating elements coupled to an input by virtue of a number of phase shifters operative for ensuring that signals radiated from the radiating elements are "in phase" or otherwise coherently added together. Each phase shifter normally corresponds to a specific radiating element and is operative for shifting the phase of signals so that all signals received from a particular direction will be in step with one another. Similarly, all signals radiated by the individual elements of the antenna will be in step with one another in some specific direction.

Changing the phase shift at each element alters the direction of the antenna beam. An antenna of this kind is called an electronically steered phased-array. Electronically steered phased arrays allow rapid changes in the position of the beam without moving large mechanical structures. In some systems, the beam can be changed from one direction to another within microseconds.

In future communication systems including satellites having phased array antennas, a large number of narrow antenna beams may provide a wide variety of communications services to ground terminals around the world. For low-earth-orbit (LEO) satellites, these beams must be continually steered in angle to maintain coverage of the earth terminals as the satellites move through their orbits. For geosynchronous-equatorial-orbit (GEO) communication satellites, there may be the need to reposition the communication beams as market conditions and regions change. However, while the foregoing principles are well known, there is no known practical phased array antenna topology operative at millimeter wave frequencies. Furthermore, there is no known phased array topology practical at millimeter wave frequencies for forming simultaneous multiple beams from a single aperture which can be independently steered over a wide angle field of view.

Accordingly, a need exists for the formation of simultaneous independently steerable multiple beams in a phased array antenna that is practical at millimeter wave frequencies.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

The exemplification set out herein illustrates a preferred embodiment of the invention in one form thereof, and such exemplification is not intended to be construed as limiting in any manner.

DETAILED DESCRIPTION OF THE DRAWINGS

The present invention provides, among other things, a system for forming simultaneous multiple communication beams which can be independently steered over a wide angle field of view. Preferred embodiments provide a sub-array module and a modular array comprised of a plurality of sub-array modules in a phased array antenna for facilitating a practical and highly efficient topology operative for forming simultaneous independently steerable multiple beams.

Figure 1:
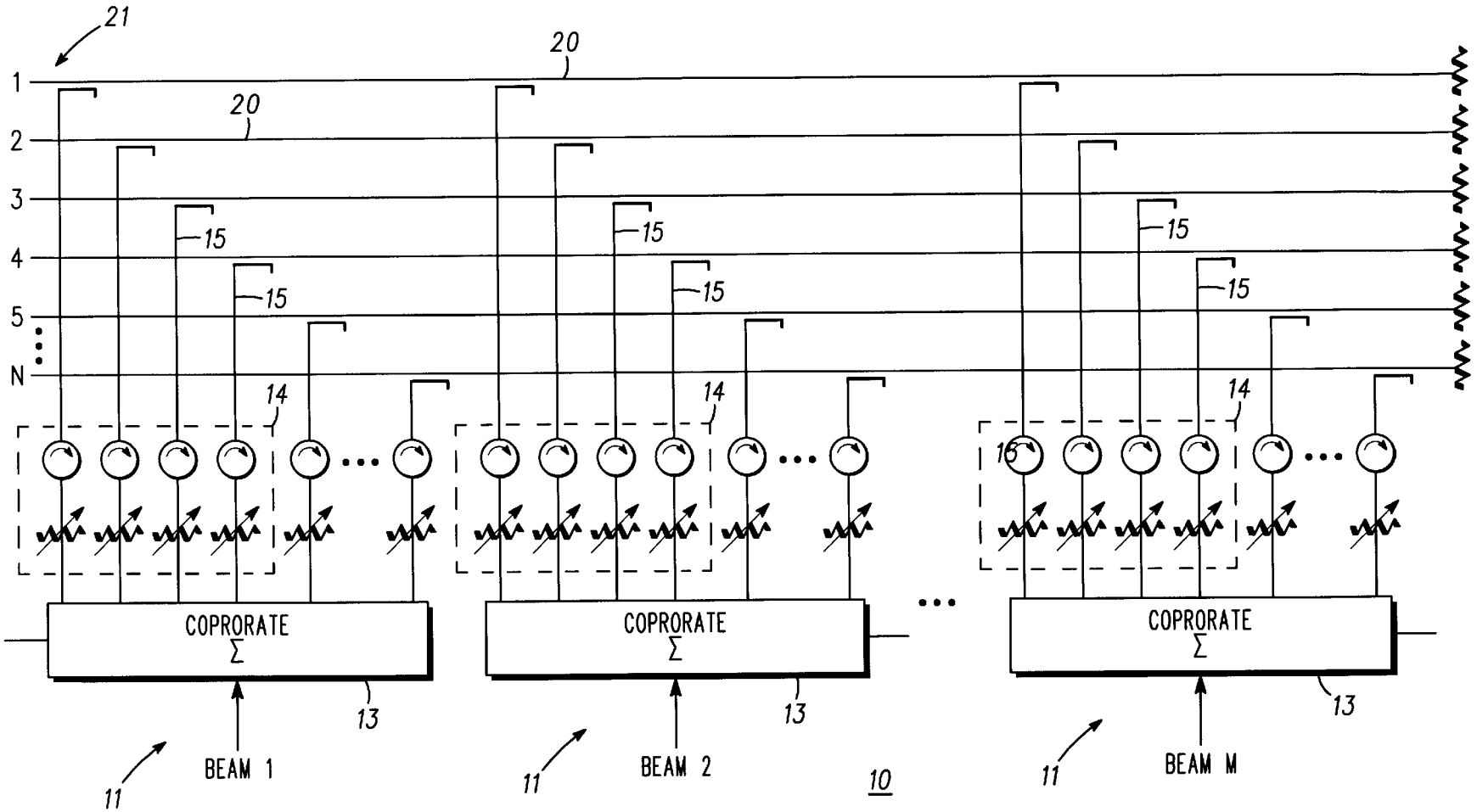
FIG. 1 illustrates a prior art multiple beam phased array system.

FIG. 1 illustrates a prior art multiple beam phased array antenna system generally designated by the reference character 10. Phased array antenna system 10 includes a two dimensional array of a plurality of beams 11 each including a corporate feed 12 coupled to a beamformer 13 having a plurality of phase shifters 14 each coupled to a supply line 15. Each supply line 15 is correspondingly coupled to a corresponding one of a plurality of feeder lines 20 each being correspondingly coupled to one of a plurality of radiating antenna elements 21 of phased array antenna system 10. Consistent with known phased array antenna systems of the foregoing type, each feeder line 20 may be a dielectrically loaded waveguide or any other suitable microwave transmission line. Although any suitable phase shifter may be used in combination with phased array antenna system 10, each phase shifter 14 of phased array antenna system 10 may be provided in the form of a monolithic microwave integrated circuit (MMIC).

Phased array antenna system 10 has been disclosed merely for the purposes of orientation, and those of ordinary skill will appreciate that beams 11 and radiating antenna elements 21 may be provided in other geometric orientations in accordance with conventional practice. Furthermore, is it well known that phased array antenna systems, such as phased array antenna system 10, may include an arbitrary number of radiating antenna elements, an arbitrary number of phase shifters, an arbitrary number of feeder lines and an arbitrary number of beamformers. However, and in accordance with conventional practice, the number of phase shifters for any given single beamformer normally corresponds to the number of radiating antenna elements, each phase shifter being operative for changing the phase of a signal for a given radiating antenna element. In this regard, and for the purposes of the ensuing discussion, the integer "M" will refer to an arbitrary plurality of radiating antenna elements 21, the integer "N" will refer to an arbitrary plurality of phase shifters, "O" will refer to an arbitrary plurality of feeder lines and "P" will refer to an arbitrary plurality of beamformers.

Figure 2:
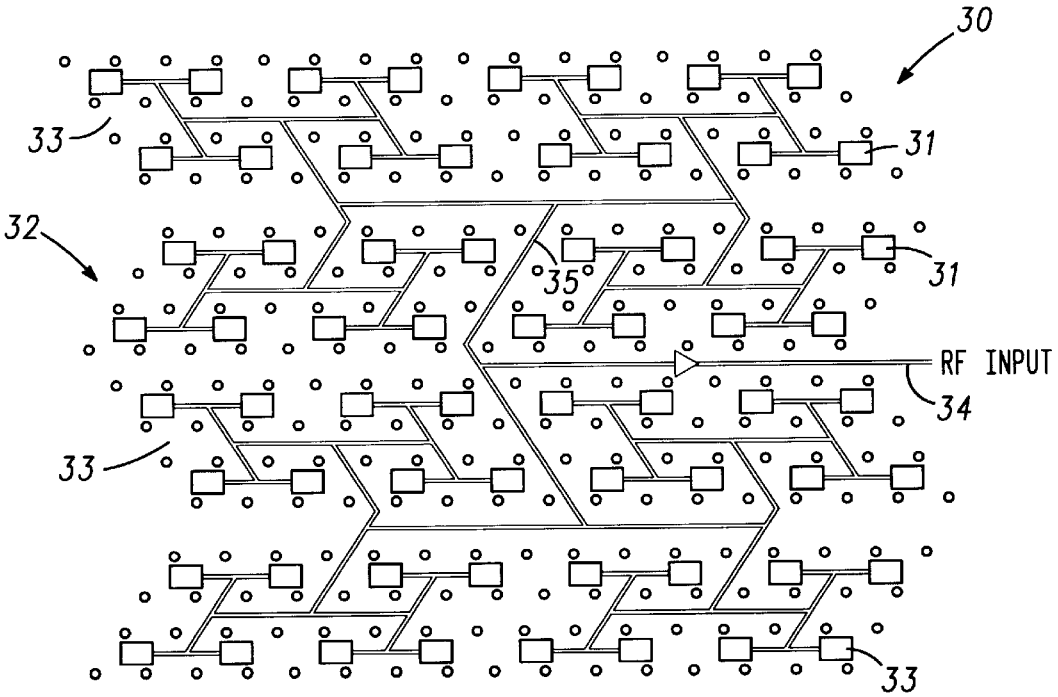
FIG. 2 illustrates a beamformer, in accordance with a preferred embodiment of the present invention.

Consistent with the advantageous teachings of the present invention, FIG. 2 illustrates a beamformer 30 including a topology or geometric orientation constructed in accordance with a preferred embodiment of the present invention and operative for forming an independently steerable beam in a phased array antenna system. Beamformer 30 includes a plurality of phase shifter elements 31 formed in a trapezoidal grid pattern or array 32 residing and extending within a primary plane. In a further and more specific aspect, phase shifter elements 31 are preferably configured in groups 33 of four each generally defining the shape of a trapezoid. Phase shifter elements 31 are each coupled to an input module 34 in beam communication by virtue of a waveguide coupler 35, with the shortest distance along a selected length of waveguide coupler 35 between each phase shifter element 31 and input module 34 defining a pathlength. Pattern 32 has the advantage of providing each pathlength between each phase shifter element 31 and input module 34 as substantially equal thereby allowing beamformer 30 to accommodate wide band coverage while eliminating unequal beam path delays between beamformer 30 and the radiating antenna elements of a phased array antenna within which beamformer 30 may be preferably employed, further details of which will be discussed as the detailed description ensues. This may be referred to as a corporate feed network. Other implementations are also possible as long as the appropriate phase and time delay conpensation is included.

Figure 3:
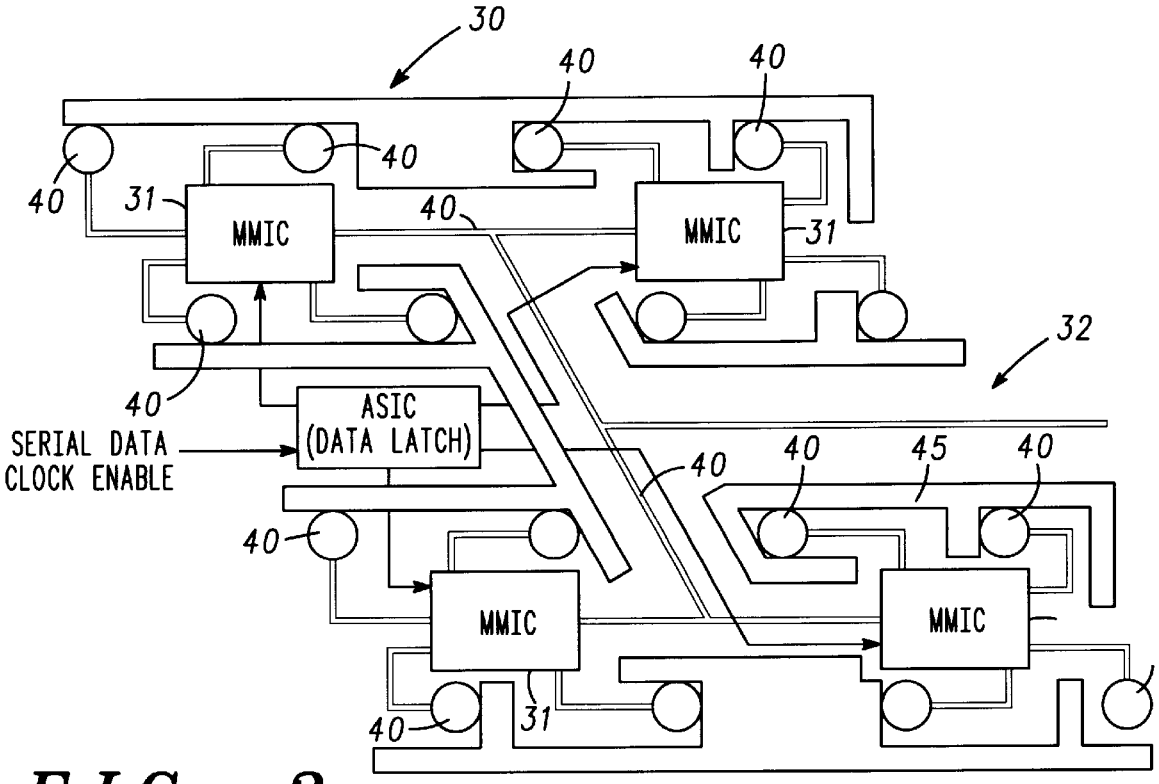
FIG. 3 illustrates a detailed portion of the beamformer of FIG. 2, in accordance with a preferred embodiment of the present invention.

Consistent with a preferred embodiment of the present invention, each phase shifter element 31 of beamformer 30 includes four individual phase shifters, although less or more may be used, wherein the total number of phase shifters of beamformer 30 is generally designated by the integer N. In the preferred embodiment, each phase shifter is a GaAs MMIC. In this regard, each N phase shifter may be desirably coupled to a corresponding one of M radiating elements of a phased array antenna (not shown in FIG. 2), wherein M and N are equal. Regarding FIG. 3 illustrating a detailed portion of beamformer 30 of FIG. 2, each N phase shifter of each phase shifter element 31 may be coupled to a one of a plurality of O feeder lines 40 by virtue of a supply line 32 in beam communication, each O feeder line 40 being further coupled to a corresponding one of M radiating antenna elements (not shown in FIG. 3). Regarding a preferred embodiment of the present invention, O feeder lines 40 reside and extending within a secondary plane different from the primary plane. In this regard, and in the interests of clarity, primary plane as defined herein is intended to be defined as a horizontal or x-axis of a standard Cartesian coordinate system, and secondary plane as defined herein is intended to be defined as a vertical or Y axis of a standard Cartesian coordinate system. However, and consistent with the nature and scope of the advantageous and preferred teachings of the present invention, primary plane and secondary plane are intended to reside in perpendicular relation relative one another. As a consequence, primary plane and secondary plane may reside in the y-axis and x-axis, respectively, without departing from the nature and scope of the present invention as herein specifically described.

Beamformer 30 includes internal walls 45 for providing, among other things, isolation between the elements. Preferably, internal walls 45 provide at least 15 dB of isolation between the elements.

Figure 4:
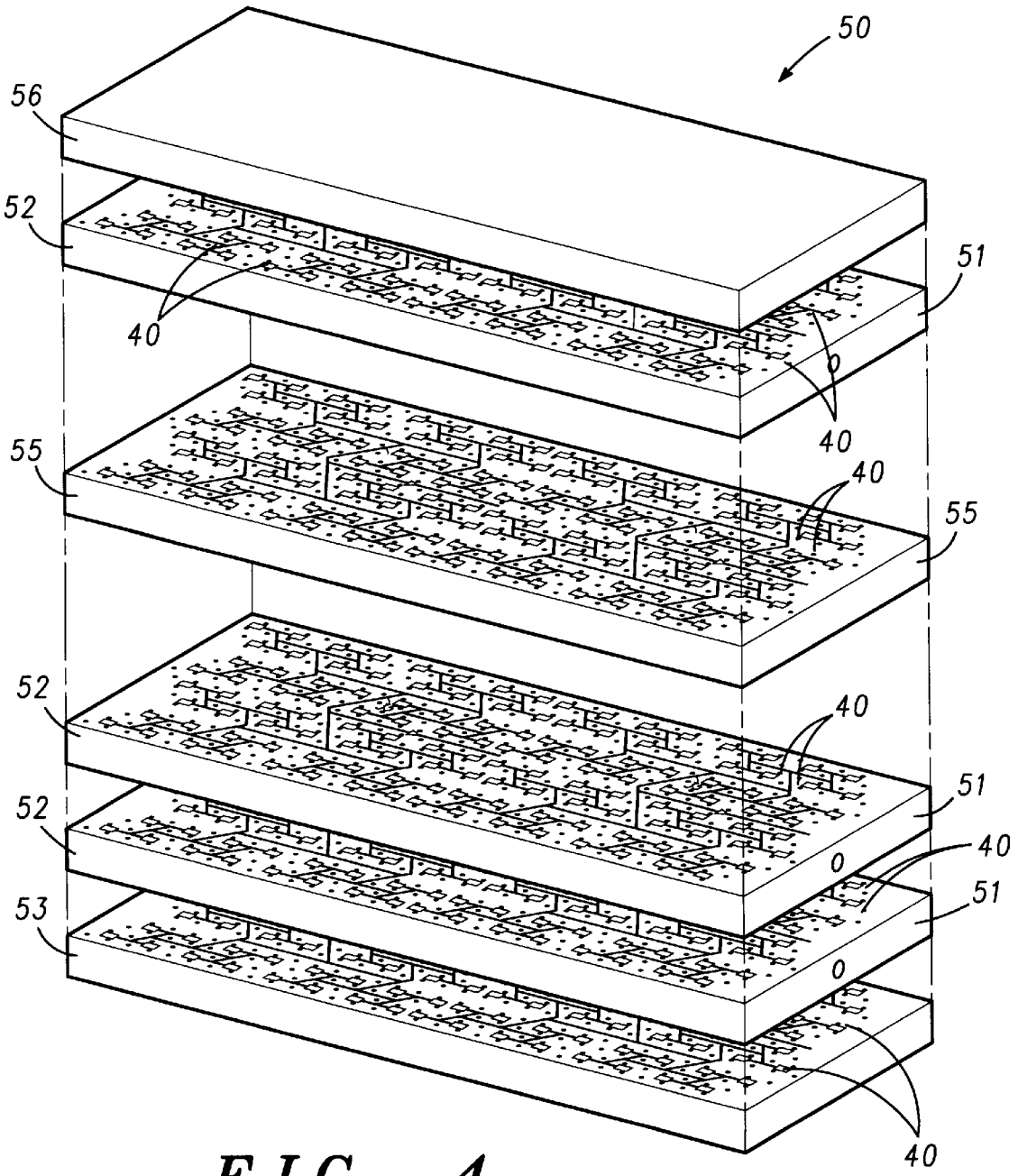
FIG. 4 illustrates a sub-array module for use in a phased array antenna, in accordance with a preferred embodiment of the present invention.

The foregoing geometric configuration of beamformer 30 has the advantage of allowing the joining of a plurality of beamformers 30 for the efficient and compact construction of a sub-array module operative for facilitating the formation of simultaneous independently steerable multiple beams in a phased array antenna. Consistent with the foregoing, attention is directed to FIG. 4 illustrating a sub-array module 50 for use in a phased array antenna (not shown) operative for forming simultaneous independently steerable multiple beams. Sub-array module 50 includes P beamformers 51 packaged or otherwise stacked one atop the other in layers 52 and in series and in beam communication with a layer 53 of radiating antenna elements of a phased array antenna (not shown in FIG. 4), wherein P refers to a predetermined and selected integer variable as previously intimated. Regarding FIG. 4, each P beamformer 51 corresponds to the geometry of beamformer 30 previously discussed in combination with FIG. 3. In this regard, layers 52 of P beamformers 51 are advantageously interconnected in series and in beam communication with layer 53 of radiating antenna elements by virtue of O feed lines 40 extending upwardly through layers 52 from layer 53 and intersecting, at a substantially perpendicular angle, each waveguide coupler 35 (not shown in FIG. 4) of each P beamformer 51 via a corresponding N phase shifter of a corresponding phase shifting element 31 (not shown in FIG. 4).

The geometric configuration of each P beamformer 51 facilitates the ability to stack or package P beamformers 51 in layers 52 in combination with layer 53 of radiating antenna elements to form sub-array module 50 of a phased array antenna. Each of P beamformers 51 facilitate beam transmission and/or receipt to and from layer 53 of radiating antenna elements along O feeder lines, all of which are common to each P beamformer 51. In this regard, and depending upon the needs of the user, input modules, such as input module 34 previously discussed in combination with FIG. 3, may be provided as a transmit module for transmitting beams, a receive module for receiving incoming beams or a combination transmit/receive module for transmitting and receiving beams thereby allowing sub-array module 50 to be employed in radar applications, terrestrial link applications, intersatellite link applications, ground terminal applications and satellite-ground link applications. Furthermore, it may be desirable to introduce an amplifier layer 55 with layers 52 of P beamformers 51 to allow build up of additional layers 52 of P beamformers 51. However, an additional amplifier layer 55 may not be necessary for phased array antennas having less than approximately 50 beamformer 51 layers 52. Also, a conventional absorption layer 56 may be added with sub-array module 50 to the top of layers 52 opposite layer 53 of radiating antenna elements if desired for inhibiting beams from reflecting into sub-array module 50. Absorption layer 56 is the termination section of the stack.

Figure 5:
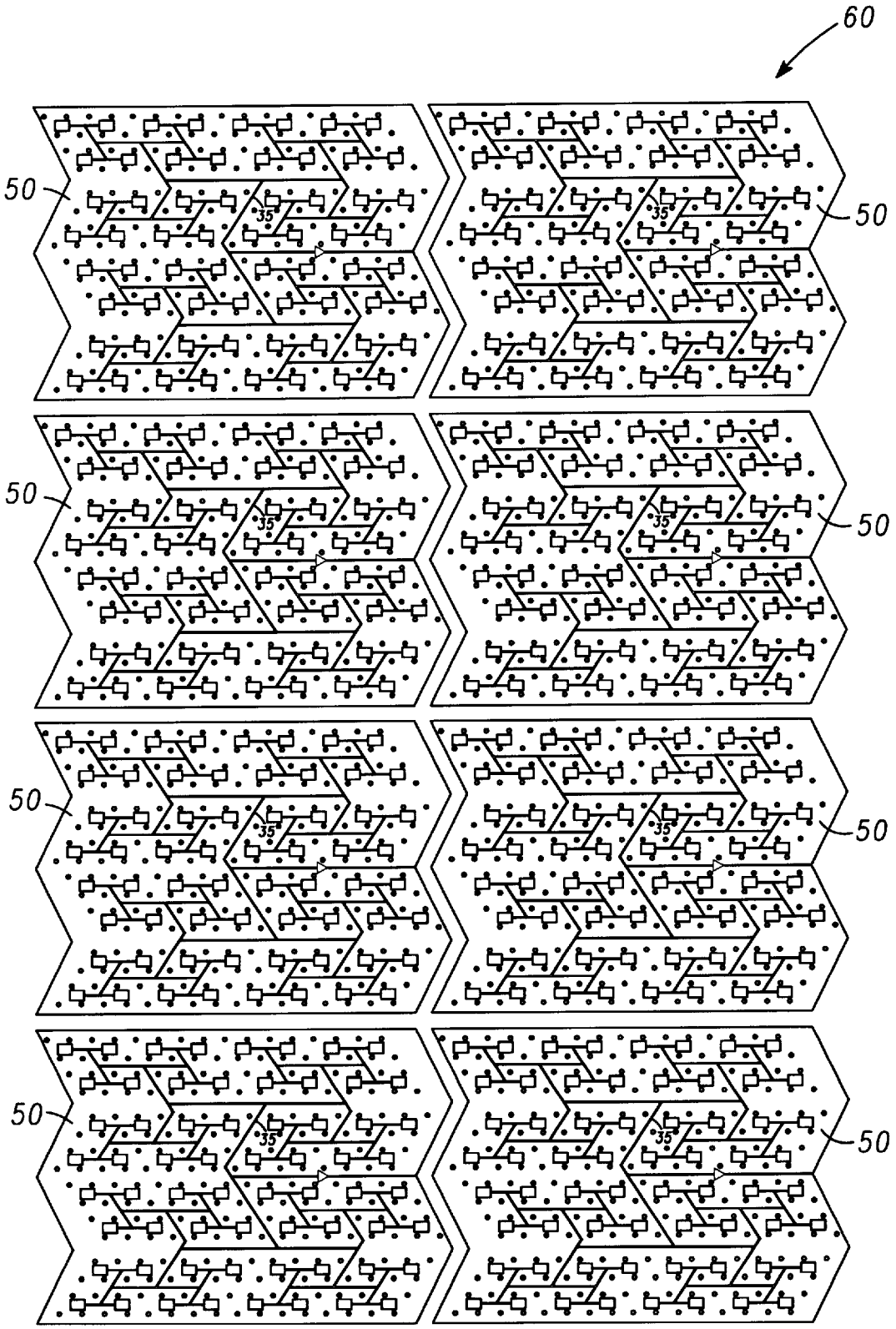
FIG. 5 illustrates a plurality of sub-array modules coupled together to form a modular array of a phased array antenna, in accordance with a preferred embodiment of the present invention.

The foregoing packaged orientation of sub-array module 50 is not only light, but also very compact and therefore particularly useful onboard orbiting satellites and other spaced-based vehicles. Furthermore, a plurality of sub-array modules 50 may also be combined together in close proximity to form a modular array 60 for use with a larger phased array antenna as illustrated in FIG. 5.

In summary, the present invention provides a beamformer 51 geometry and sub-array module 50 operative for facilitating the formation of simultaneous independently steerable beams in a phased array antenna. The geometry of beamformer 51 facilitates that advantageous and compact packaging or stacking of an arbitrary and selected number of layers 52 of P beamformers 51 operative for facilitating the formation of large numbers of simultaneous and independently steerable beams. Furthermore, because the pathlength between each phase shifting element 31 of each beamformer 30 (FIG. 2) comprising layers 52 P beamformers 51 are substantially equal, the time delay between each layer 52 of P beamformers 51 and layer 53 of radiating antenna elements is substantially equal thereby facilitating the in step or in phase receipt and/or transmission of a plurality of simultaneous independently steerable beams. Furthermore, each radiating antenna element within layer 53 may be spaced at approximately ½ wavelength, thereby allowing the beams to be steered over a wide angle field of view to angles near 60 degrees off of the normal to the face of the phased array antenna, although this is not an essential feature and the radiating elements of layer 53 may be spaced apart to an extent greater than ½ wavelength if desired.

In the preferred embodiments, the shape of the sub-array module has several advantages. For example, this shape allows convenient implementation of the corporate feed, it allows build up of larger array because of interlocking shape, and the serrated edges reduces sidelobes resulting from the periodicity of additional subarray modules.

In one preferred embodiment, the shape of the sub-array module is essentially rectangular with two straight edges on opposite sides, and two jagged or serrated edges on the remaining two sides. The serrated edges are comprised of four angled segments which are approximately 2 wavelengths long, corresponding to four times the element spacing. As shown in FIGS. 2 and 5, this shape allows convenient implementation of the corporate feed to elements which are laid out in a trapezoidal pattern, while at the same time allowing build up of larger arrays because of interlocking shape. The serrated edge also reduces sidelobes resulting from the periodicity of the element pattern. Each phase shifting element, for example, is provided by a corresponding sub-array module having first and second substantially parallel opposite sides, and third and fourth opposite sides connected to the first and second sides, the third and fourth opposite sides each comprised of four angled segments for interlocking with adjacent of said sub-array modules, each of said four angled segments being approximately four wavelengths in length.

An additional feature of the array is that in its preferred embodiment, there are no amplifiers, which yields the advantages making the beamformer bi-directional so it is ideal for use in pulsed radar or communication systems where the same beamformer could be time-shared for transmit and receive. This also makes it possible to manufacture the same sub-array for both transmit and receive (production advantage).

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

What is claimed is:

1. A modular beamformer for providing millimeter-wave signals to a plurality of radiating elements of a phased array antenna, the beamformer comprising:

a plurality of substantially identical beamformer modules arranged in a stacked configuration, each beamformer module being in a primary plane; and a plurality of feeder lines extending through each beamformer module of the plurality, each feeder line coupled to one of the radiating elements, wherein each beamformer module comprises;

a plurality of Gallium Arsenide (GaAs) Monolithic Microwave Integrated Circuit (MMIC) phase shifter elements for providing phase-shifted signals to more than one of the feeder lines; and an input signal path interconnecting each one of the plurality of phase shifter elements, wherein each feeder line is arranged in a secondary plane substantially perpendicular the primary plane, each one of the feeder lines comprising a dielectrically loaded wave guide.

2. The modular beamformer of claim 1, wherein the input signal path provides a substantially equal pathlength between each one of the plurality of phase shifter elements and an input signal source.

3. The beamformer of claim 2, wherein each one of the plurality of GaAs MMIC phase shifter elements includes an MMIC device.

4. The modular beamformer of claim 3, wherein each MMIC device includes a plurality of MMIC phase shifters, each one of the MMIC phase shifters coupled to a specific feeder line of the plurality of feeder lines.

5. The modular beamformer of claim 4 wherein a phase length between each corresponding one of the plurality of feeder lines and each corresponding one of the plurality of GaAs MMIC phase shifter elements is substantially equal.

6. The beamformer of claim 1, wherein each one of the plurality of feeder lines comprises a dielectrically loaded waveguide having a circular cross-section.

7. The beamformer of claim 4 further comprising a second plurality of said substantially identical beamformer modules arranged in a second stacked configuration, and wherein the plurality of GaAs MMIC phase shifting elements are disposed in a trapezoidal pattern within each beamformer module of said first and second pluralities, and wherein each beamformer module of both first and second pluralities has first and second substantially parallel opposite sides, and third and fourth opposite sides connected to the first and second sides, the third and fourth opposite sides each comprised of angled segments, the third opposite sides of each beamformer module of said first plurality being interlocked with the fourth opposite sides of each adjacent beamformer module of said second plurality.

8. A modular phased array antenna for the formation of simultaneous independently steerable multiple beams, the modular phased array antenna comprising:

a plurality of sub-array modules combined together in close proximity, each one of the plurality of sub-array modules including, a plurality of input modules, a layer of a plurality of radiating antenna elements, a plurality of beamformer modules arranged in a stacked configuration and each connected to one of the plurality of input modules in beam communication, each one of the plurality of beamformer modules including a plurality of Gallium Arsenide (GaAs) Monolithic Microwave Integrated Circuit (MMIC) phase shifter elements arranged in a primary plane, wherein the plurality of phase shifter elements corresponds to a predetermined number of the plurality of radiating antenna elements, and a waveguide coupler interconnecting each one of the plurality of GaAs MMIC phase shifters to a corresponding one of the plurality of input modules in beam communication; and a plurality of feeder lines arranged in a secondary plane substantially perpendicular to the primary plane, each one of the plurality of feeder lines coupled to one of the plurality of radiating antenna elements and to one of the plurality of GaAs MMIC phase shifters of each one of the plurality of beamformers, each feeder line comprised of a circular dielectrically loaded waveguide extending through each beamformer of the plurality.

9. The phased array antenna of claim 8, wherein the waveguide coupler defines a pathlength between each one of the plurality of GaAs MMIC phase shifter elements and the corresponding input module, wherein the pathlength between each one of the plurality of GaAs MMIC phase shifters and the input module is substantially equal.

10. The phased array antenna of claim 9, wherein each one of the plurality of GaAs MMIC phase shifter elements includes a GaAs MMIC.

11. The phased array antenna of claim 10, wherein each GaAs MMIC includes a plurality of phase shifters, each phase shifter of the plurality of phase shifters being coupled to one feeder line of the plurality of feeder lines in beam communication.

12. The phased array antenna of claim 10, wherein a phase length between a corresponding one of the plurality of radiating antenna elements and a corresponding one of the plurality of phase shifter elements is substantially equal.

13. The phased array antenna of claim 11, wherein each one of the plurality of feeder lines includes a dielectrically loaded circular waveguide.

14. The phased array antenna of claim 13 further comprising a second plurality of said substantially identical beamformers arranged in a second stacked configuration, and wherein the plurality of GaAs MMIC phase shifting elements are disposed in a trapezoidal pattern within each beamformer of said first and second pluralities, and wherein each beamformer has first and second substantially parallel opposite sides, and third and fourth opposite sides connected to the first and second sides, the third and fourth opposite sides each comprised of angled segments, the third opposite sides of each beamformer of said first plurality being interlocked with the fourth opposite sides of each adjacent beamformer of said second plurality.

* * * * *